US011179735B2

(12) United States Patent
Wu et al.

(10) Patent No.: US 11,179,735 B2
(45) Date of Patent: Nov. 23, 2021

(54) SHOWERS

(71) Applicant: Purity (Xiamen) Sanitary Ware Co., Ltd., Xiamen (CN)

(72) Inventors: James Wu, Taichung (TW); Alex Wu, Taichung (TW); Ce-Wen Yang, Xiamen (CN)

(73) Assignee: PURITY (XIAMEN) SANITARY WARE CO., LTD., Xiamen (CN)

( * ) Notice: Subject to any disclaimer, the term of this patent is extended or adjusted under 35 U.S.C. 154(b) by 136 days.

(21) Appl. No.: 16/232,949

(22) Filed: Dec. 26, 2018

(65) Prior Publication Data

US 2020/0206755 A1 Jul. 2, 2020

(51) Int. Cl.
*B05B 1/18* (2006.01)
*B05B 1/16* (2006.01)

(52) U.S. Cl.
CPC ..... *B05B 1/185* (2013.01); *B05B 1/1636* (2013.01)

(58) Field of Classification Search
CPC ..... B05B 1/14; B05B 1/16; B05B 1/1627; B05B 1/1636; B05B 1/1645; B05B 1/1654; B05B 1/185
USPC ..... 239/538, 562; 137/625.46, 625.47
See application file for complete search history.

(56) References Cited

U.S. PATENT DOCUMENTS 6,286,158 B1 * 9/2001 Lin ..... B05B 1/1654 239/447
2014/0209708 A1 * 7/2014 Tsai ..... B05B 1/18 239/556

* cited by examiner

*Primary Examiner* — Jason J Boeckmann
(74) *Attorney, Agent, or Firm* — Birch, Stewart, Kolasch & Birch, LLP

(57) ABSTRACT

A shower includes a first shower assembly, a rotatable valve and a second shower assembly. The first shower assembly has a first inlet bore and a first outlet bore individually separated from each other. The rotatable valve has two diverter flow paths which are separated from each other, and has a second inlet bore and a second outlet bore, wherein the second inlet bore communicates with the second outlet bore. The second shower assembly has a third outlet bore communicating with the second outlet bore. The second shower assembly is connected to the rotatable valve. The second shower assembly is turnable relative to the first shower assembly to rotate the rotatable valve. When the second shower assembly is turned to rotate the rotatable valve, the first outlet bore, the second inlet bore or the both communicate with the first inlet bore through at least one of the diverter flow paths.

19 Claims, 12 Drawing Sheets

SHOWERS

BACKGROUND OF THE INVENTION

1. Technical Field

The present disclosure relates generally to a shower, and more particularly to a shower having a turnable ring which could be turned to control the outlet functions.

2. Description of Related Art

Recently, a conventional shower merely has a single outlet surface to let water out flow. In addition, such conventional shower usually provides a single outlet function in a single outlet direction; especially, the conventional shower usually outlets in a single spray angle. However, users are never satisfied with the conventional shower owing to the single outlet direction and the single spray angle of the conventional shower.

Accordingly, what is needed is a shower that has multiple outlet surfaces in different directions, and provides various spray angles for users during a shower. At least for the above reasons, the conventional showers still have room for improvements.

BRIEF SUMMARY OF THE INVENTION

In view of the above, the primary objective of the present disclosure is to provide a shower having a turnable shower assembly, which could be turned to change different outlet functions in multiple directions and in multiple spray angles for users during a shower.

The present disclosure provides a shower including a first shower assembly, a rotatable valve and a second shower assembly. The first shower assembly has a first inlet bore and a first outlet bore individually separated from each other. The rotatable valve has two diverter flow paths which are separated from each other. The rotatable valve inlet has a second inlet bore and a second outlet bore, wherein the second inlet bore communicates with the second outlet bore. A second shower assembly has a third outlet bore communicating with the second outlet bore. The second shower assembly is connected to the rotatable valve, and the second shower assembly is turnable relative to the first shower assembly to rotate the rotatable valve. When the second shower assembly is turned to rotate the rotatable valve, the first outlet bore of the first shower assembly, the second inlet bore of the rotatable valve or the both communicate with the first inlet bore through at least one of the diverter flow paths of the rotatable valve.

With the aforementioned design, the second shower assembly of the shower could be turned to rotate the rotatable valve, the shower could outlet from the first shower assembly, the second shower assembly or the both, whereby the shower in one embodiment of the present disclosure could provide different outlet functions in multiple directions and in multiple spray angles for users during a shower.

BRIEF DESCRIPTION OF THE SEVERAL VIEWS OF THE DRAWINGS

The present disclosure will be best understood by referring to the following detailed description of some illustrative embodiments in conjunction with the accompanying drawings, in which.

DETAILED DESCRIPTION OF THE INVENTION

Figure 1:
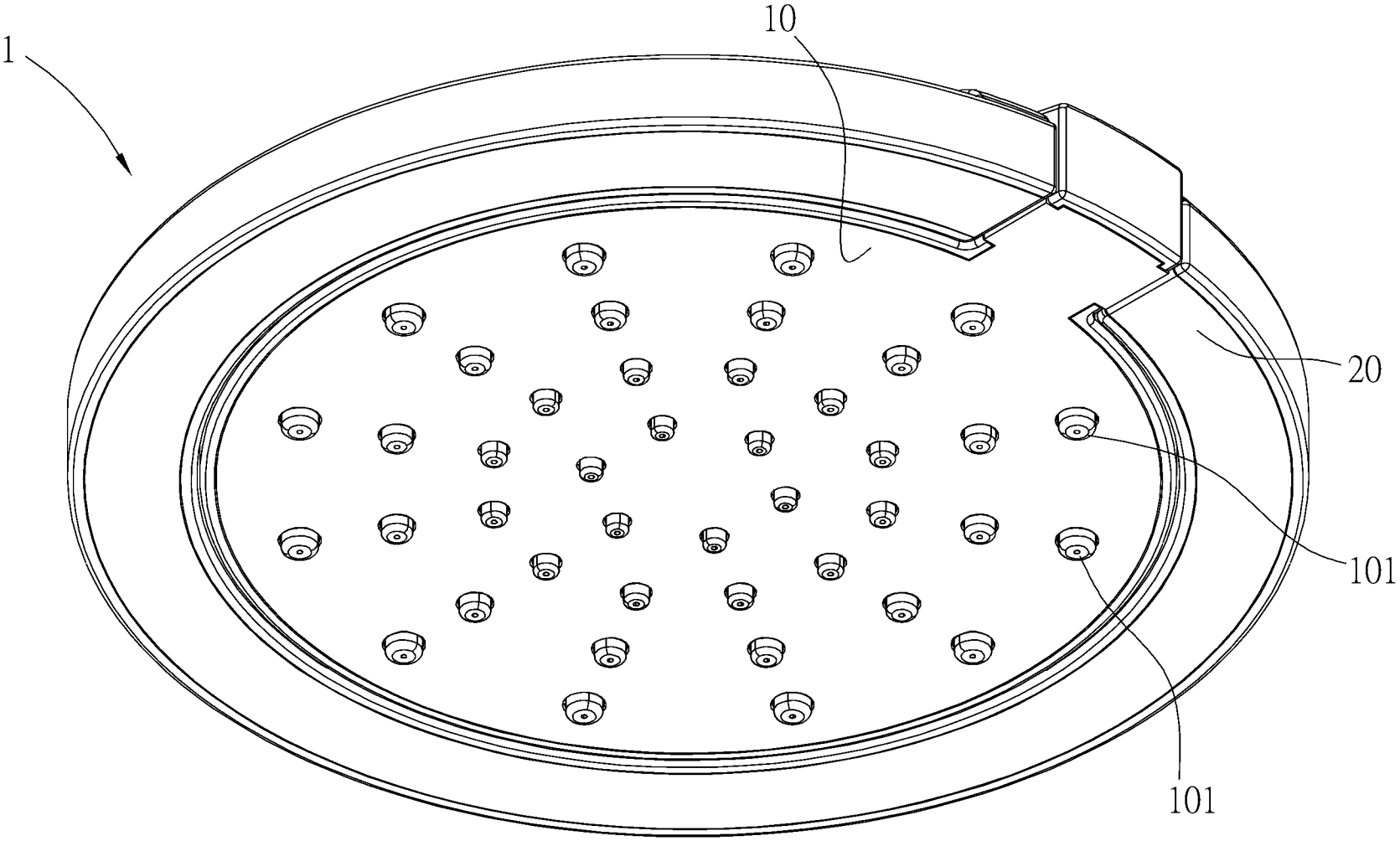
FIG. 1 is a perspective view of a shower of an embodiment of the present disclosure at the first position angle between the first shower assembly and the second shower assembly.
Figure 2:
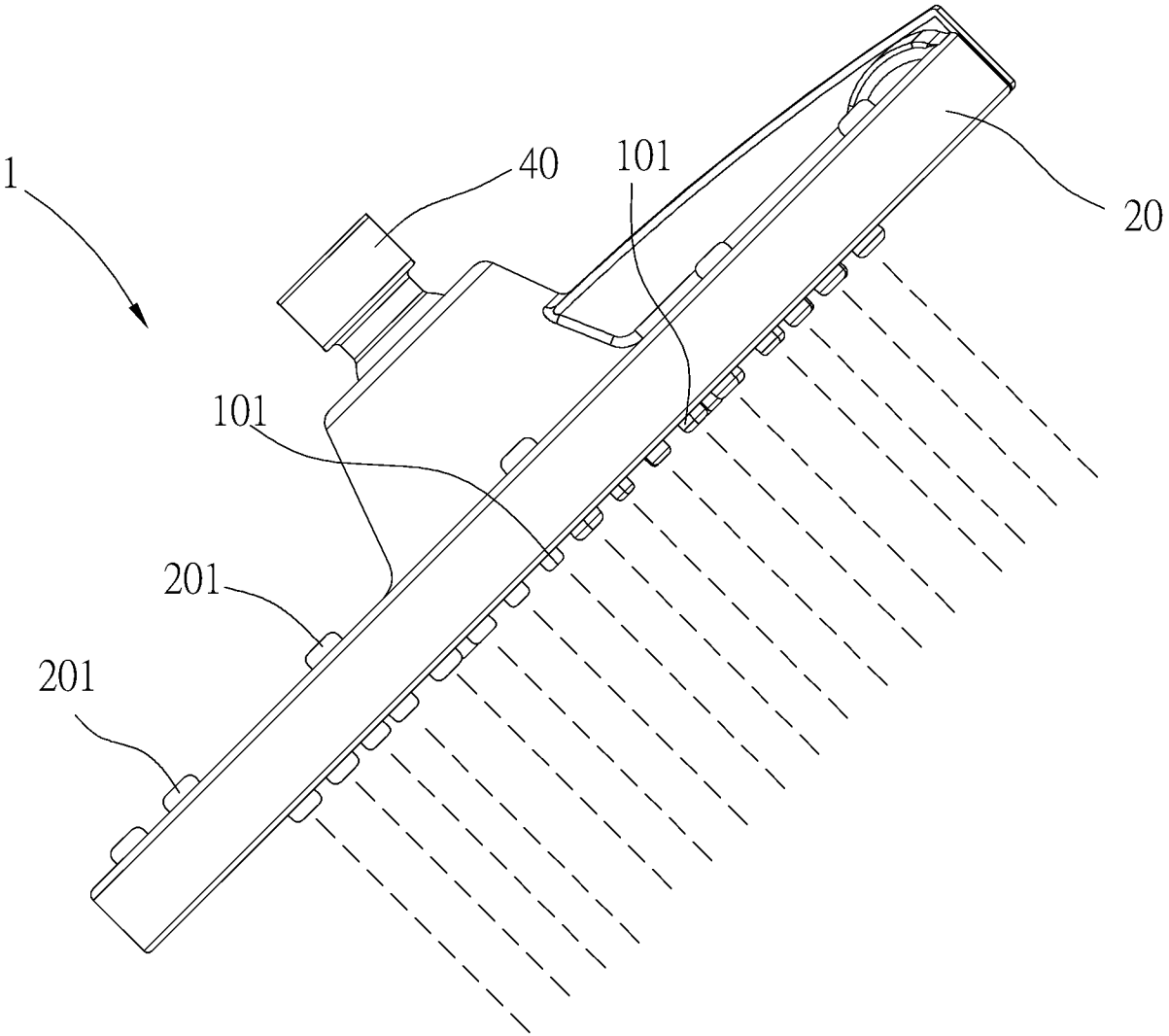
FIG. 2 is a side view of the shower of the embodiment of the present disclosure at the first position angle between the first shower assembly and the second shower assembly.

As illustrated in FIG. 1 to FIG. 12, a shower 1 is provided, including a first shower assembly 10, a rotatable valve 30 and a second shower assembly 20. The first shower assembly 10 has a first inlet bore 102 and a first outlet bore 104, wherein the first inlet bore 102 and the first outlet bore 104 are individually separated from each other. The first shower assembly 10 has a first inlet bore 102 and a first outlet bore 104 individually separated from each other.

The rotatable valve 30 has two diverter flow paths 302, 304 which are separated from each other. The rotatable valve 30 has a second inlet bore 303 and a second outlet bore 305, wherein the second inlet bore 303 communicates with the second outlet bore 305.

The second shower assembly 20 has a third outlet bore 202 communicating with the second outlet bore 305. It is worthy to note that, the second shower assembly 20 is connected to the rotatable valve 30, and the second shower assembly 20 is turnable relative to the first shower assembly 10 to rotate the rotatable valve 30.

When the second shower assembly 20 is turned to rotate the rotatable valve 30, the first bore 104 of the first shower assembly 10, the second inlet bore 303 of the rotatable valve 30 or the both communicate with the first inlet bore 102 through at least one of the diverter flow paths 302, 304 of the rotatable valve 30.

Figure 3:
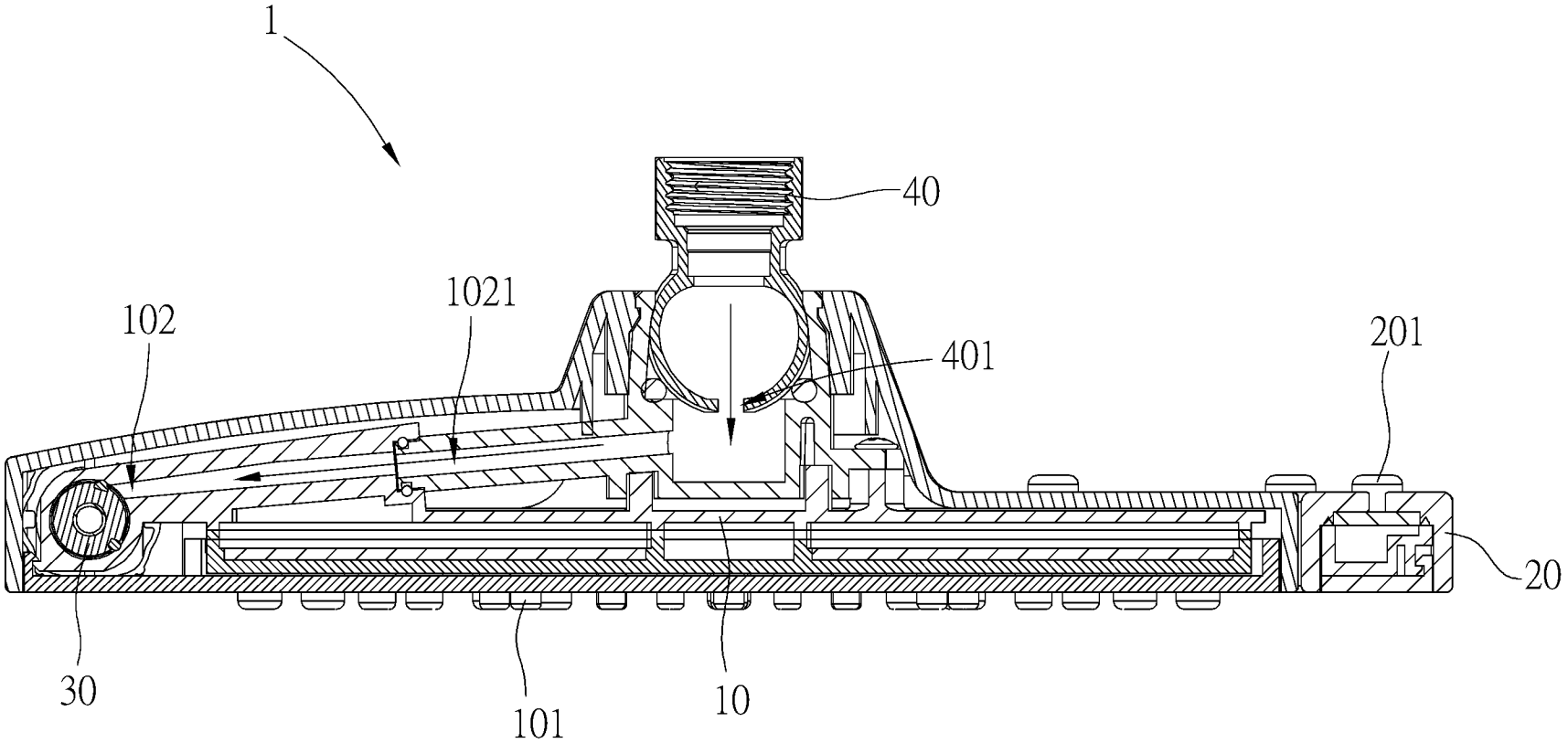
FIG. 3 is a cross-sectional view of the shower of the embodiment of the present disclosure at the first position angle between the first shower assembly and the second shower assembly.

In FIG. 3, the shower 1 includes an inlet connector 40 connected to the first shower assembly 10. The inlet connector 40 has a flow channel 401 communicating with the first inlet bore 102 through an inlet channel 1021 of the first shower assembly 10. The first outlet bore 104 communicates with a plurality of first nozzles 101 of the first shower assembly 10 through an outlet channel 1041 of the first shower assembly 10, as shown in FIG. 4.

Figure 4:
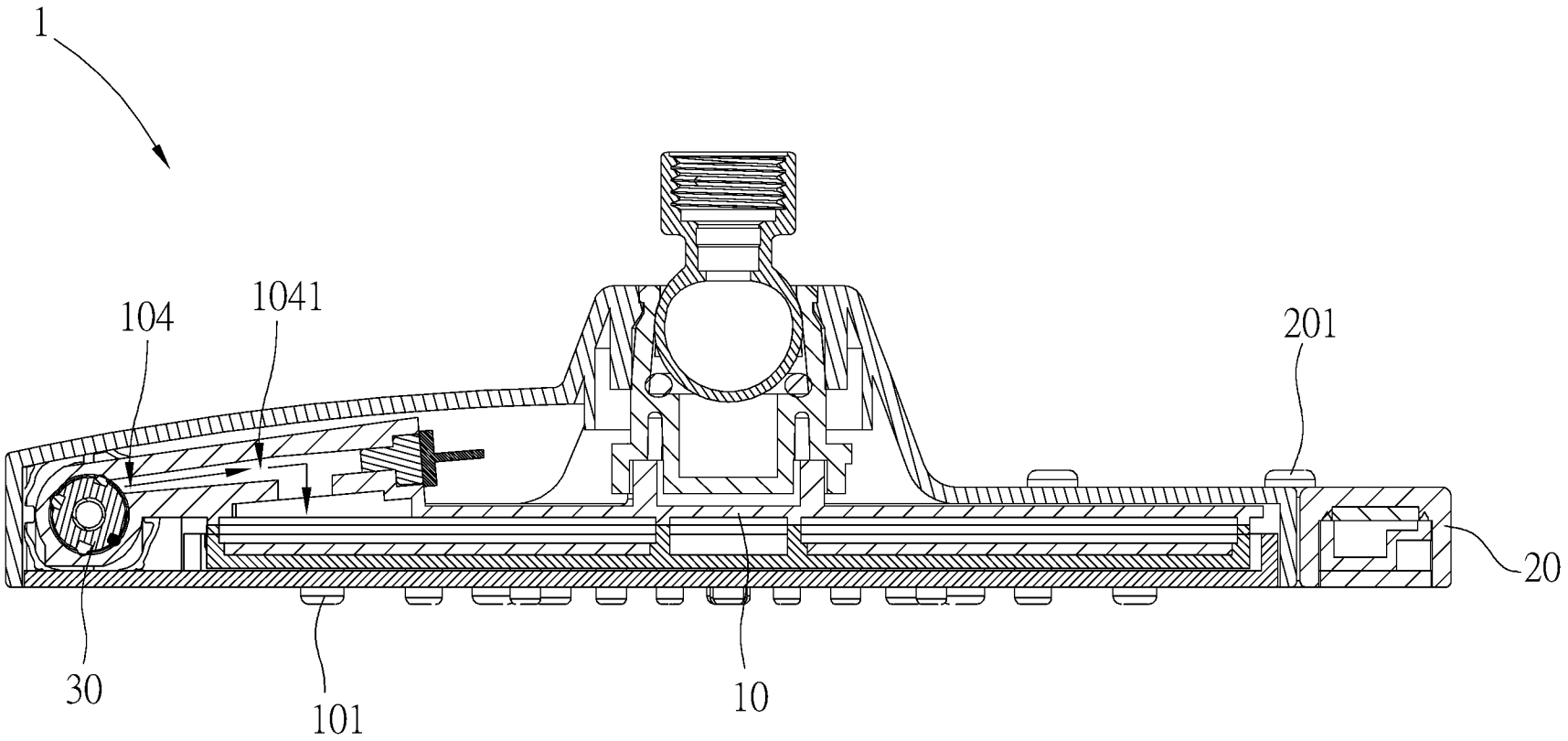
FIG. 4 is a cross-sectional view of the shower of the embodiment of the present disclosure at the first position angle between the first shower assembly and the second shower assembly.
Figure 5:
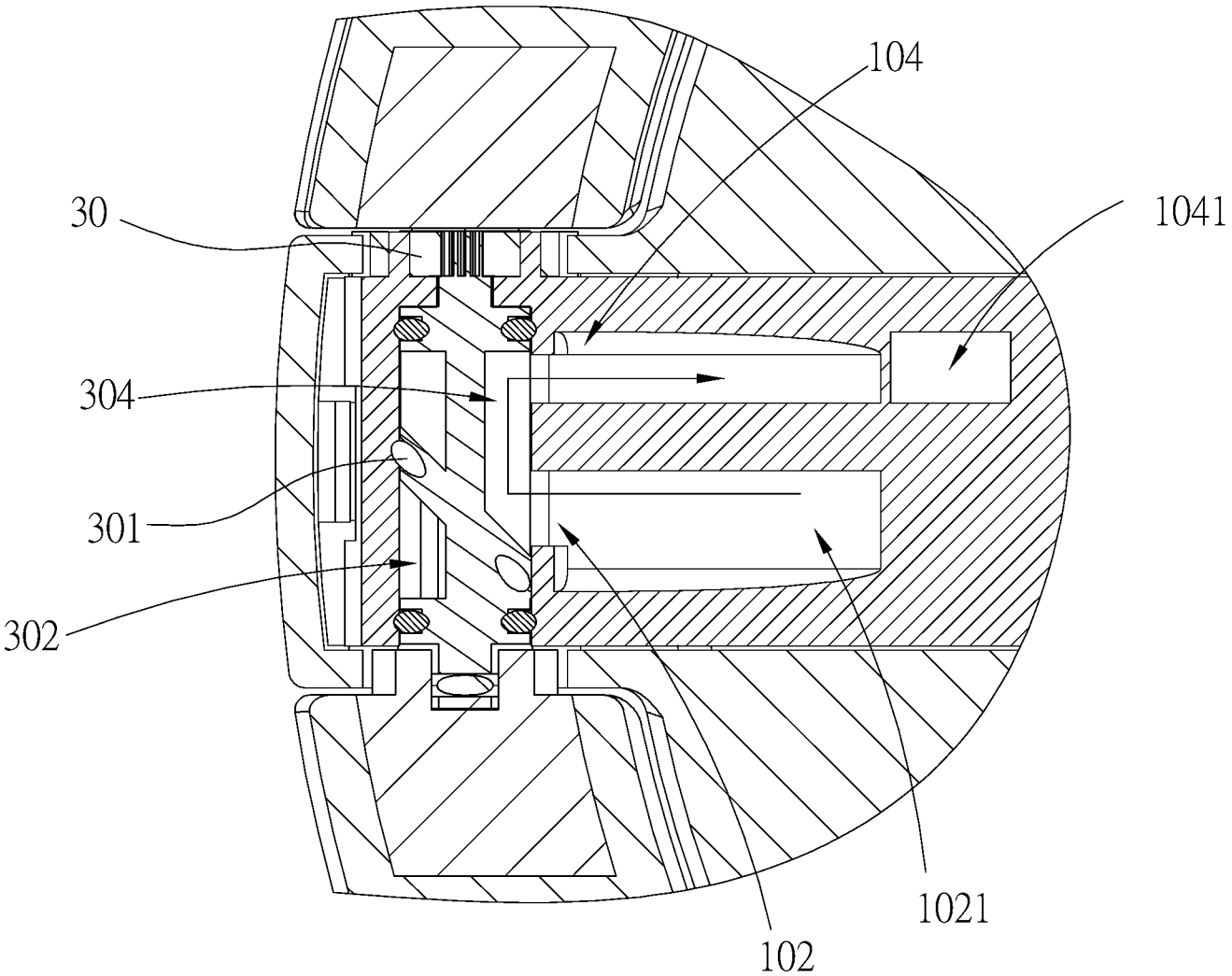
FIG. 5 is a partial cross-sectional view of the shower of the embodiment of the present disclosure at the first position angle between the first shower assembly and the second shower assembly.
Figure 6:
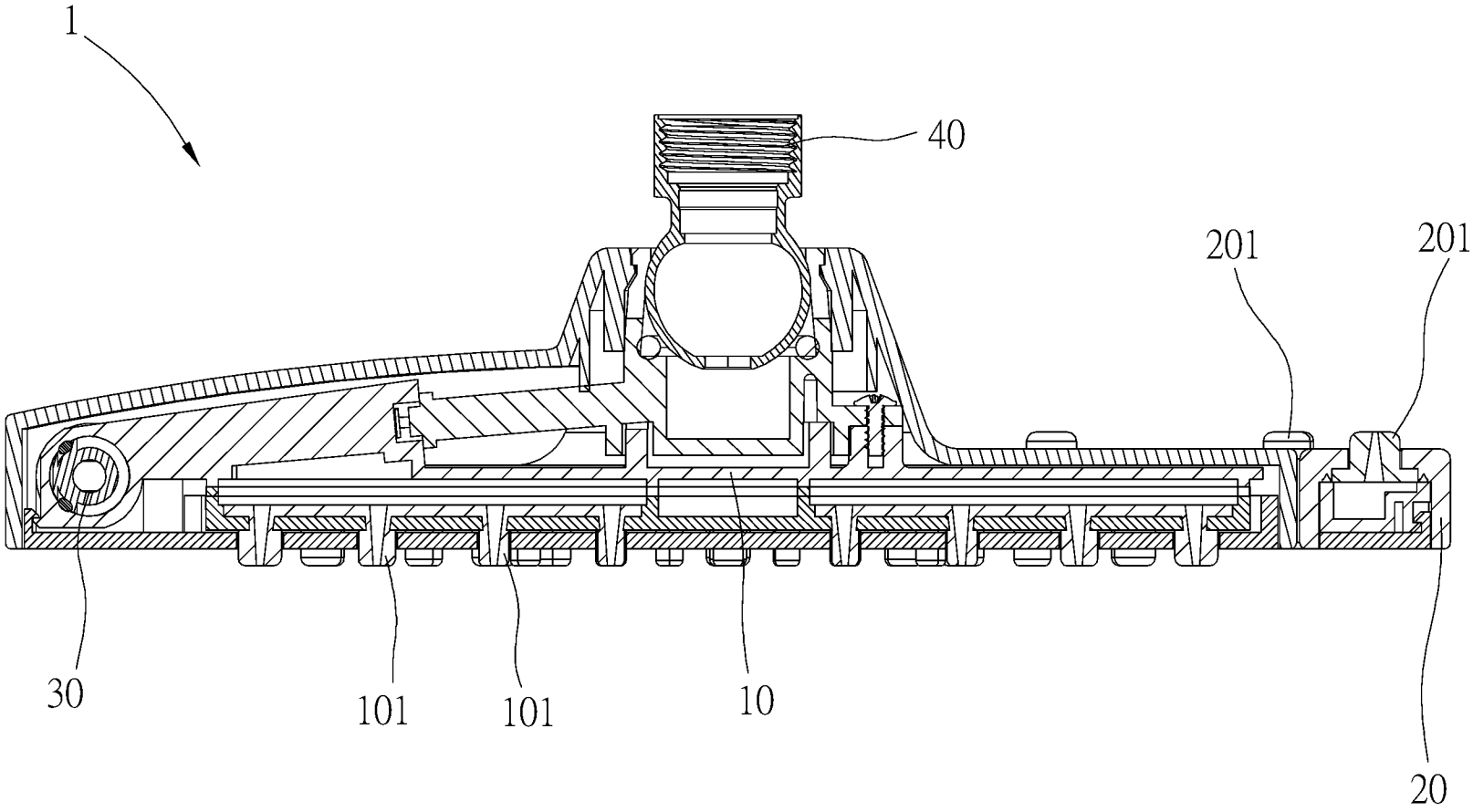
FIG. 6 is a cross-sectional view of the shower of the first embodiment of the present disclosure at the first position angle between the first shower assembly and the second shower assembly.

In FIG. 3 to FIG. 5, the rotatable valve 30 is positioned in front of the first inlet bore 102 and the first outlet bore 104 of the first shower assembly 10. In one embodiment of the present disclosure, the rotatable valve 30 is positioned on an edge of the first shower assembly 10, and the second shower assembly 20 is connected to the first shower assembly 10 at the edge of the first shower assembly 10 through the rotatable valve 30. In addition, the rotatable valve 30 is also positioned on an edge of the second shower assembly 20. In one embodiment of the present disclosure, the first inlet bore 102 and the first outlet bore 104 of the first shower assembly 10 are coplanar, but are not limited thereto; in practice, the first inlet bore 102 and the first outlet bore 104 could be positioned on two different surfaces as long as the first inlet bore 102 and the first outlet bore 104 could be individually corresponding to the diverter flow paths 302, 304 of the rotatable valve 30.

Figure 9:
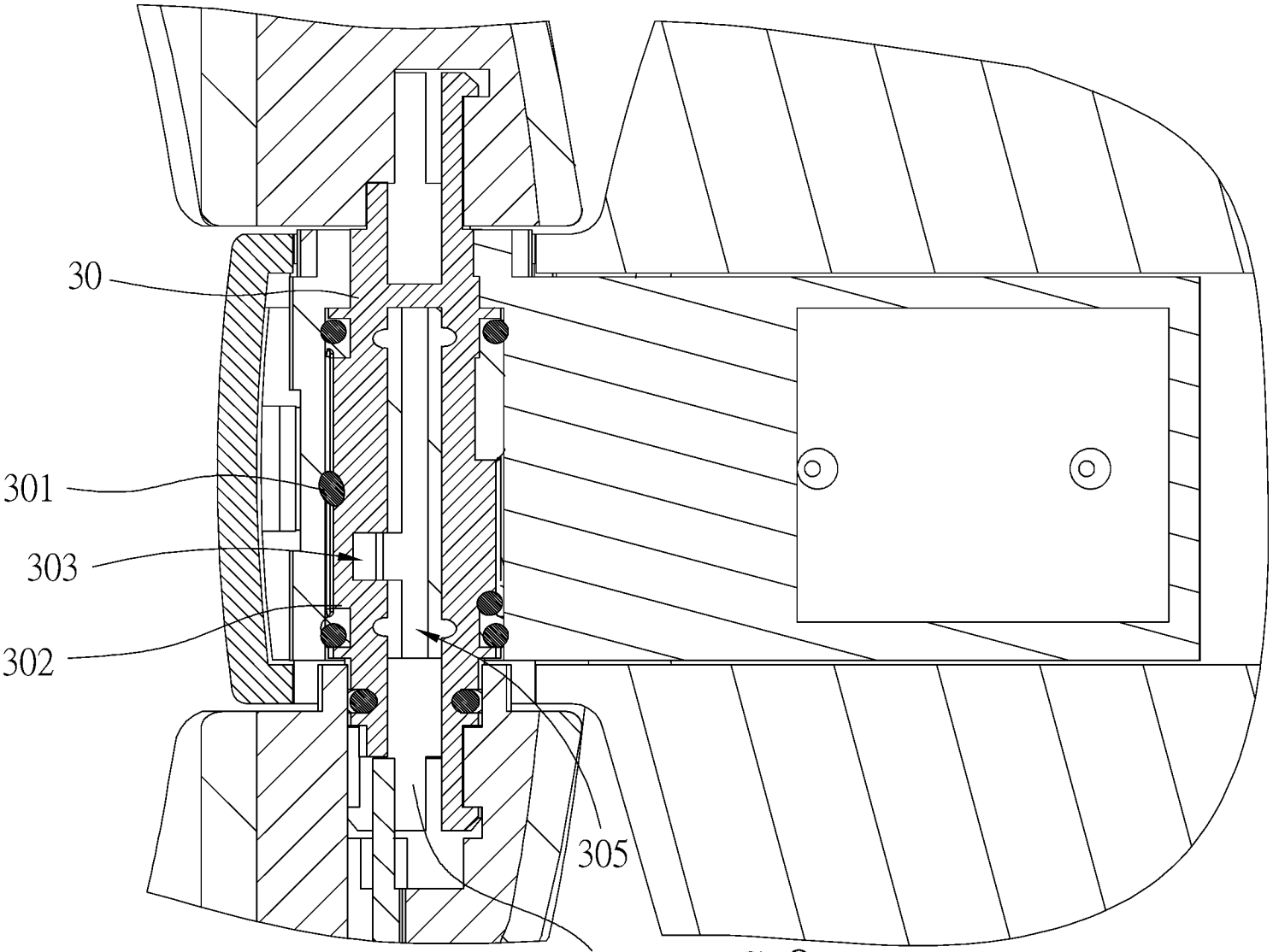
FIG. 9 is a partial cross-sectional view of the shower of the embodiment of the present disclosure at the second position angle between the first shower assembly and the second shower assembly.
Figure 12:
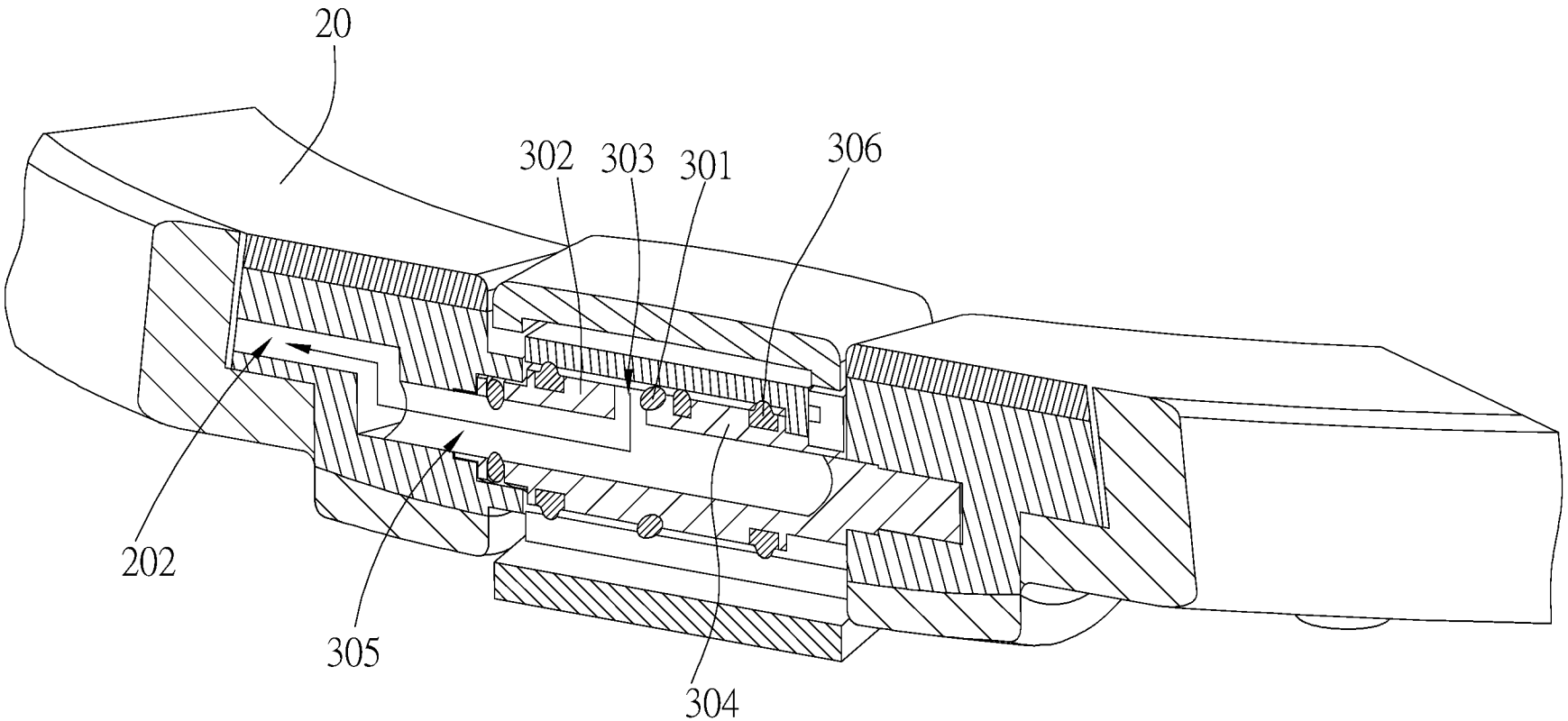
FIG. 12 is a partial cross-sectional view of the shower of the embodiment of the present disclosure at the third position angle between the first shower assembly and the second shower assembly.

In one embodiment of the present disclosure, the second inlet bore 303 and the second outlet bore 305 of the rotatable valve 30 are not coplanar, as shown in FIG. 9 and FIG. 12. However, in practice, the second inlet bore 303 and the second outlet bore 305 of the rotatable valve 30 could be coplanar, whereby to positioned on the same side wall of the rotatable valve 30. In one embodiment of the present disclosure, the second inlet bore 303 and the second outlet bore 305 are orthogonal to each other. Furthermore, the second inlet bore 303 is open on a side wall of the rotatable valve 30, and the second outlet bore 305 is open on an end of the rotatable valve 30.

In one embodiment of the present disclosure, the rotatable valve 30 includes a first sealing ring 301 to separate the diverter flow path 302 from the diverter flow path 304. The first sealing ring 301 is tilted to wind around the rotatable valve 30, whereby to separate the diverter flow path 302 from the diverter flow path 304. In one embodiment of the present disclosure, the second inlet bore 303 is positioned in the divert flow path 302.

Referring to FIG. 1 to FIG. 12, the first shower assembly 10 and the second shower assembly 20 have a plurality of positioning angles therebetween. In one embodiment of the present disclosure, the positioning angles between the first shower assembly and the second shower assembly comprises a first positioning angle, a second positioning angle θ1 and a third positioning angle θ2. In one embodiment of the present disclosure, the diverter flow paths have a first flow path 304 and a second flow path 302 individually separated from each other.

In FIG. 1 to FIG. 6, when the first shower assembly 10 and the second shower assembly 20 stay at the first positioning angle, the first outlet bore 104 communicates with the first inlet bore 102 through the first flow path 304, but the second outlet bore 303 and the second flow path 302 are blocked, whereby to merely outlet from the first nozzles 101 of the first shower assembly 10. In one embodiment of the present disclosure, the first positioning angle is in a range of 0° to 90°. In one embodiment of the present disclosure, the first positioning angle is preferred in a range of 0° to 40°. In FIG. 1 to FIG. 6, the first positioning angle is 0° as an example.

Figure 7:
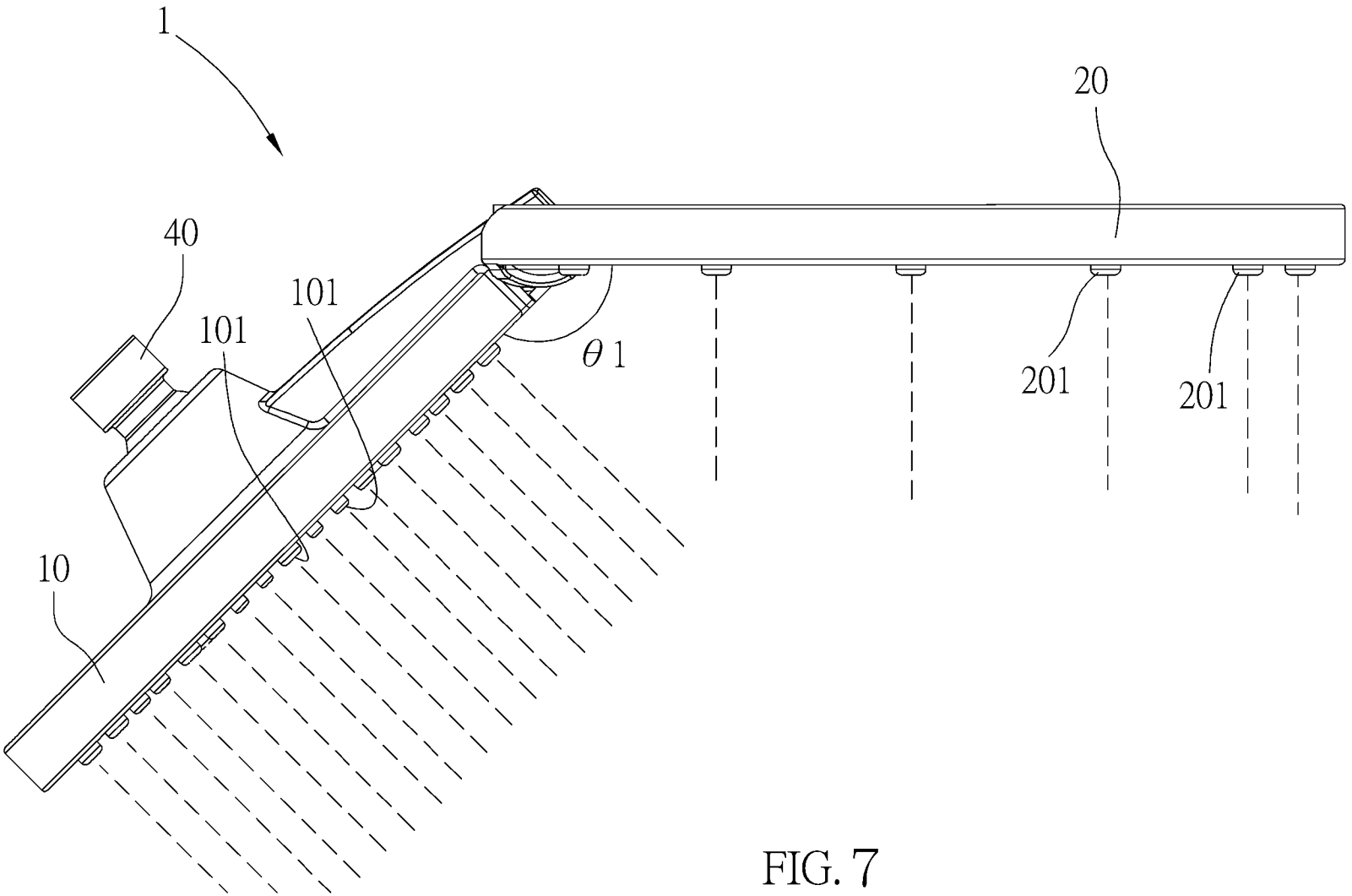
FIG. 7 is a side view of the shower of the embodiment of the present disclosure at the second position angle between the first shower assembly and the second shower assembly.
Figure 8:
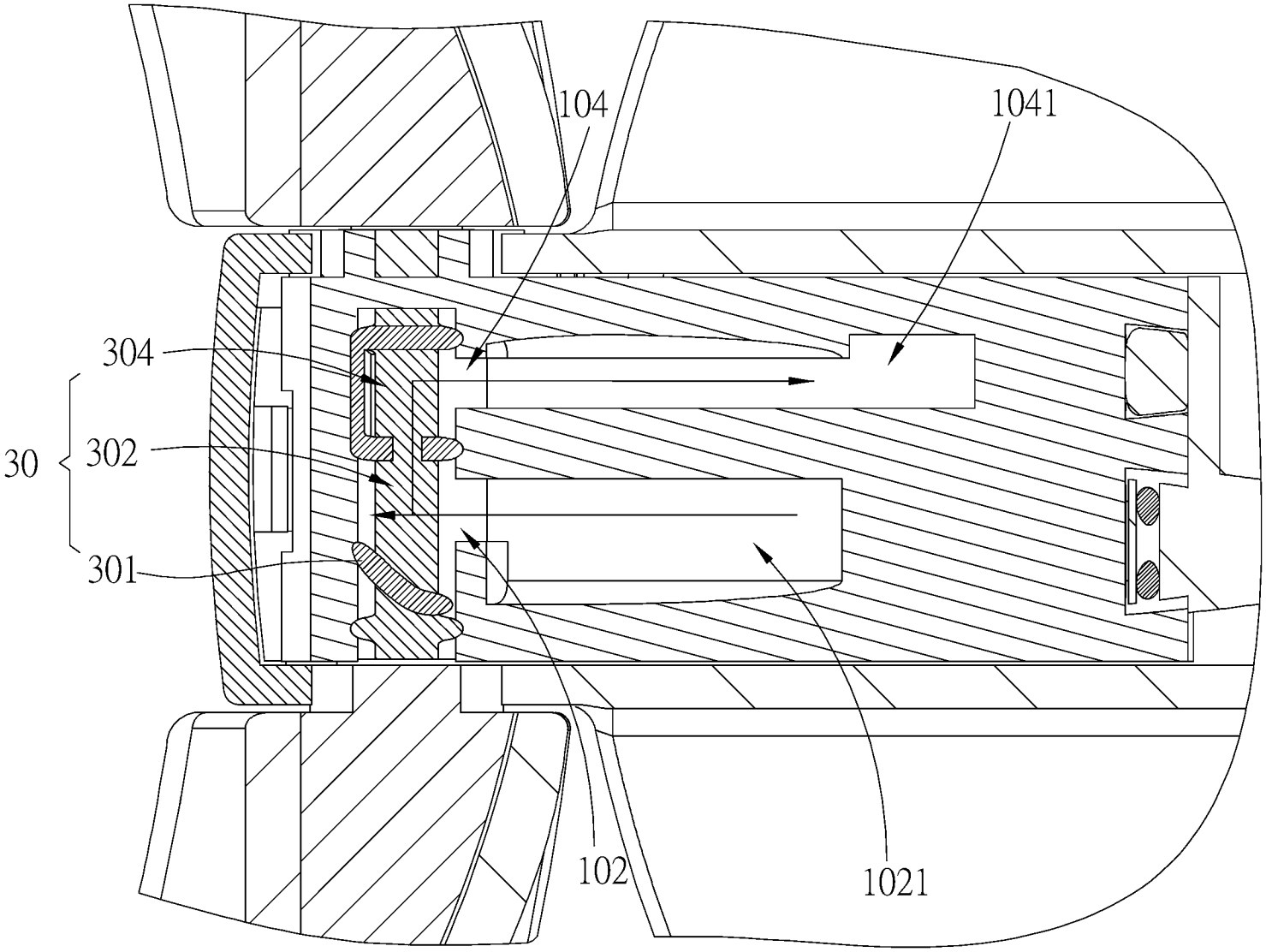
FIG. 8 is a partial cross-sectional view of the shower of the embodiment of the present disclosure at the second position angle between the first shower assembly and the second shower assembly.

In FIG. 7 to FIG. 9, when the first shower assembly 10 and the second shower assembly 20 stay at the second positioning angle θ1, the first outlet bore 104 and the second inlet bore 303 communicate with the first inlet bore 102 through the first flow paths 302 and the second flow paths 304, whereby to simultaneously outlet from the first shower assembly 10 and the second shower assembly 20. In one embodiment of the present disclosure, the second positioning angle θ1 is greater than 90°, and is less than and equal to 150°. In one embodiment of the present disclosure, the second positioning angle θ1 is greater than 120°, and is less than and equal to 140°. In one embodiment of the present disclosure, the second positioning angle θ1 is 135° as an example.

Figure 10:
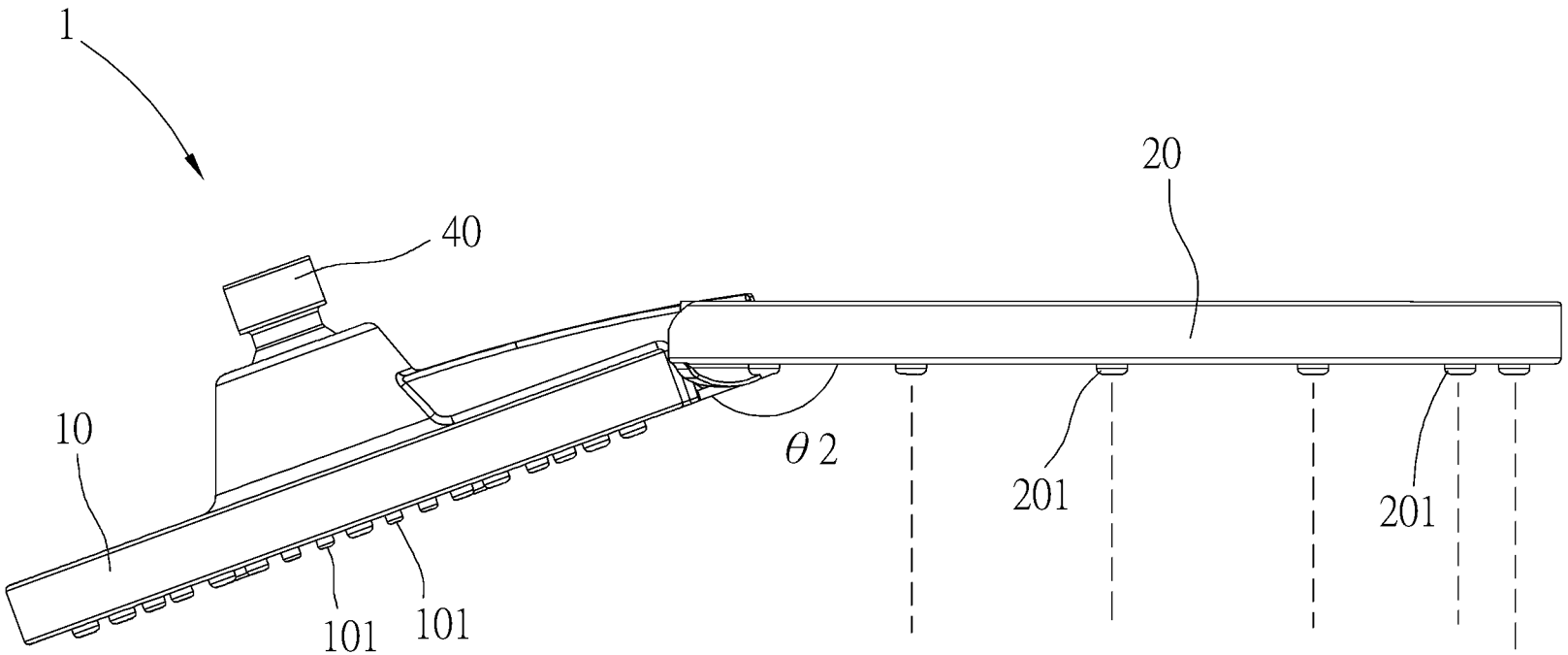
FIG. 10 is a side view of the shower of the embodiment of the present disclosure at the third position angle between the first shower assembly and the second shower assembly.
Figure 11:
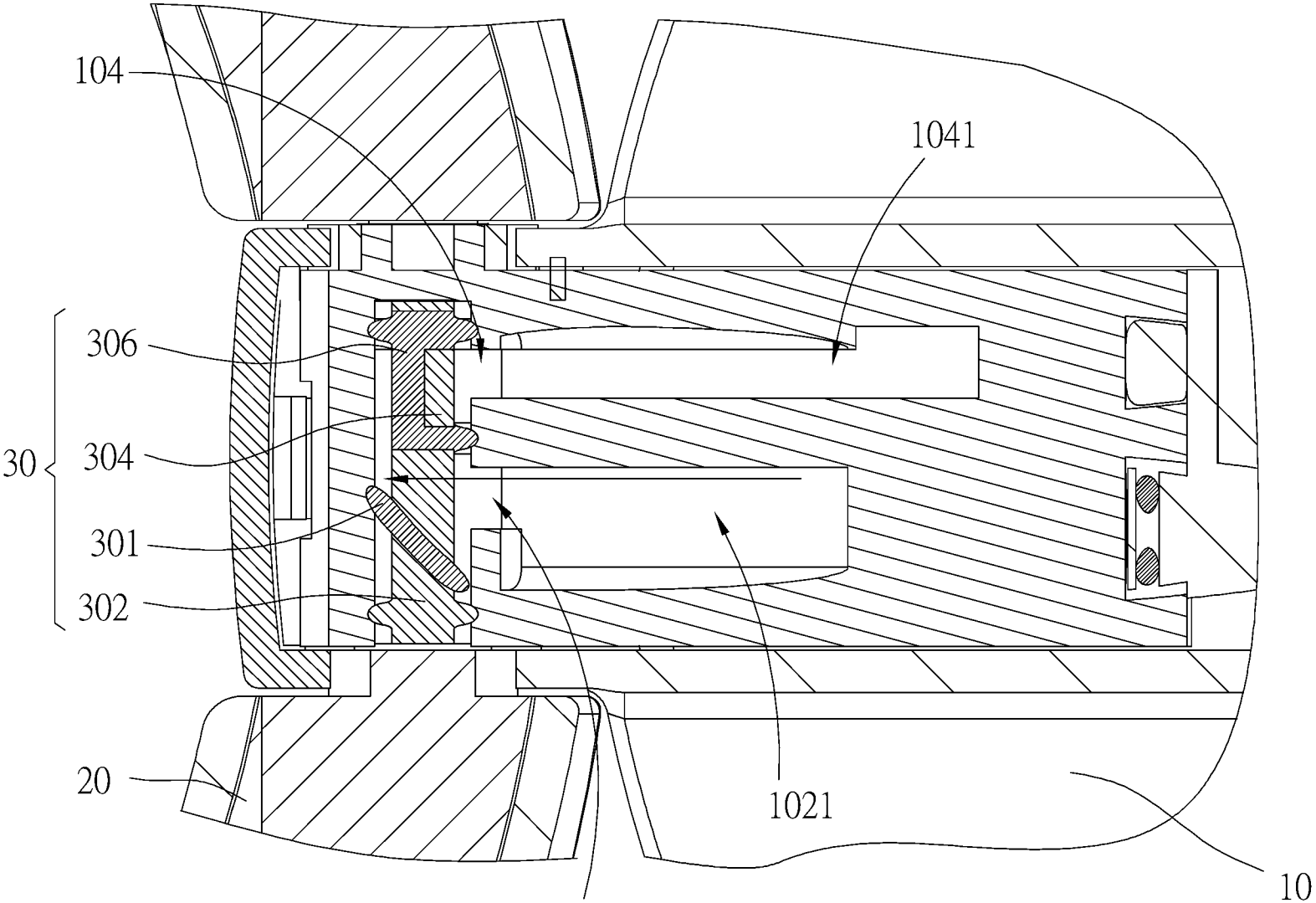
FIG. 11 is a partial cross-sectional view of the shower of the embodiment of the present disclosure at the third position angle between the first shower assembly and the second shower assembly.

In FIG. 10 to FIG. 12, when the first shower assembly 10 and the second shower assembly 20 stay at the third positioning angle θ2, the second inlet bore 303 of the rotatable valve 30 communicates with the first inlet bore 102 of the first shower assembly 10 through the second flow path 302, but the first outlet bore 104 and the first flow path 304 are blocked, whereby to merely outlet from the second nozzles 201 of the second shower assembly 20. In one embodiment of the present disclosure, the rotatable valve 30 includes a second sealing ring 306 for sealing the first outlet bore 104 of the first shower assembly 10. In one embodiment of the present disclosure, the second sealing ring 306 has a profile fitting a shape of the first outlet bore 104. In one embodiment of the present disclosure, the third positioning angle is greater than 150°, and is less than and equal to 180°. In one embodiment of the present disclosure, the third positioning angle is greater than 155°, and is less than and equal to 170°. In one embodiment of the present disclosure, the third positioning angle is 160° as an example.

In FIG. 1 to FIG. 12, the second shower assembly 20 is in a ring shape, and the second shower assembly 20 winds around the first assembly 10. In one embodiment of the present disclosure, the first shower assembly 10 has an outer profile, and the second shower assembly 20 has an inner profile fitting the outer profile. However, it is not limited thereto; in practice, the inner profile of the second shower assembly 20 could be different from the outer profile of the first shower assembly 10.

With the aforementioned design, the second shower assembly of the shower could be turned to rotate the rotatable valve, the shower could outlet from the first shower assembly, the second shower assembly or the both, whereby the shower in one embodiment of the present disclosure could provide different outlet functions in multiple directions and in multiple spray angles for users during a shower.

It must be pointed out that the embodiments described above are only some preferred embodiments of the present disclosure. All equivalent structures which employ the concepts disclosed in this specification and the appended claims should fall within the scope of the present disclosure.

What is claimed is:

1. A shower, comprising:

a first shower assembly, having a plurality of first nozzles, and a first inlet bore and a first outlet bore individually separated from each other, wherein the first inlet bore communicates with the first nozzles, and the first shower assembly outputs water through the first nozzles;

a rotatable valve, having two diverter flow paths which are separated from each other, and having a second inlet bore and a second outlet bore, wherein the second inlet bore communicates with the second outlet bore; and a second shower assembly having a plurality of second nozzles, and a third outlet bore communicating with the second outlet bore, wherein the second shower assembly is connected to the rotatable valve, and the second shower assembly is turnable relative to the first shower assembly to rotate the rotatable valve; when the second shower assembly is turned to rotate the rotatable valve, the first outlet bore of the first shower assembly, the second inlet bore of the rotatable valve or the both communicate with the first inlet bore through at least one of the diverter flow paths of the rotatable valve, wherein the second inlet bore and the second outlet bore are not coplanar and are open at different directions, wherein the first shower assembly and the second shower assembly have a plurality of positioning angles therebetween, when the first shower assembly and the second shower assembly stay at one of the positioning angles which is 0 degree, the first nozzles and the second nozzles face opposite directions, wherein the diverter flow paths have a first flow path and a second flow path individually separated from each other, and wherein one of the plurality of positioning angles between the first shower assembly and the second shower assembly is configured in such a manner that the first outlet bore and the second inlet bore communicate with the first inlet bore through the first and second flow paths, and to simultaneously outlet from the first and second shower assemblies, thereby the first shower assembly and the second shower assembly simultaneously outputting water through the first nozzles and the second nozzles, respectively.

2. The shower of claim 1, wherein the first inlet bore and the first outlet bore of the first shower assembly are coplanar.

3. The shower of claim 1, wherein the second inlet bore is open on a side wall of the rotatable valve, and the second outlet bore is open on an end of the rotatable valve.

4. The shower of claim 1, wherein the rotatable valve comprises a first sealing ring to separate one of the diverter flow paths from the other one of the diverter flow paths.

5. The shower of claim 4, wherein the first sealing ring is tilted to wind around the rotatable valve, whereby to separate one of the diverter flow paths from the other one of the diverter flow paths.

6. The shower of claim 4, wherein the second inlet bore is positioned in one of the divert flow paths.

7. The shower of claim 4, wherein the rotatable valve comprises a second sealing ring for sealing the first outlet bore.

8. The shower of claim 7, wherein the second sealing ring has a profile fitting a shape of the first outlet bore.

9. The shower of claim 1, wherein the first shower assembly and the second shower assembly have a plurality of positioning angles therebetween.

10. The shower of claim 9, wherein the positioning angles between the first shower assembly and the second shower assembly comprises a first positioning angle, a second positioning angle and a third positioning angle.

11. The shower of claim 10, wherein when the first shower assembly and the second shower assembly stay at the first positioning angle, the first outlet bore communicates with the first inlet bore through the first flow path, but the second outlet bore and the second flow path are blocked, whereby to simply output through the first shower assembly.

12. The shower of claim 11, wherein the first positioning angle is in a range of 0° to 90°.

13. The shower of claim 10, wherein when the first shower assembly and the second shower assembly stay at the second positioning angle, the first outlet bore and the second inlet bore communicate with the first inlet bore through the first and second flow paths, whereby to simultaneously outlet from the first and second shower assemblies.

14. The shower of claim 13, wherein the second positioning angle is greater than 90°, and is less than and equal to 150°.

15. The shower of claim 10, wherein when the first shower assembly and the second shower assembly stay at the third positioning angle, the second inlet bore communicates with the first inlet bore through the second flow path, but the first outlet bore and the first flow path are blocked, whereby to simply output through the second shower assembly.

16. The shower of claim 15, wherein the third positioning angle is greater than 150°, and is less than and equal to 180°.

17. The shower of claim 1, wherein the second shower assembly is in a ring shape, and winds around the first assembly.

18. The shower of claim 1, wherein the rotatable valve is positioned on an edge of the first shower assembly, and the second shower assembly is connected to the first shower assembly at the edge of the first shower assembly through the rotatable valve.

19. The shower of claim 1, wherein the first shower assembly has an outer profile, and the second shower assembly.

* * * * *